US008272778B2

(12) United States Patent
Hiranuma et al.

(10) Patent No.: US 8,272,778 B2
(45) Date of Patent: Sep. 25, 2012

(54) WATCH

(75) Inventors: Haruki Hiranuma, Mihama-ku (JP); Kazutaka Imai, Mihama-ku (JP)

(73) Assignee: Seiko Instruments Inc. (JP)

( * ) Notice: Subject to any disclaimer, the term of this patent is extended or adjusted under 35 U.S.C. 154(b) by 394 days.

(21) Appl. No.: 12/658,710

(22) Filed: Feb. 12, 2010

(65) Prior Publication Data

US 2010/0220560 A1 Sep. 2, 2010

(30) Foreign Application Priority Data

Feb. 13, 2009 (JP) ..... 2009-031377

(51) Int. Cl.
*G04B 37/00* (2006.01)

(52) U.S. Cl. ..... 368/295; 368/294

(58) Field of Classification Search ..... 368/294–296
See application file for complete search history.

(56) References Cited

U.S. PATENT DOCUMENTS

| | | | | |
|---|---|---|---|---|
| 6,616,329 | B1 * | 9/2003 | Sasaki et al. | 368/294 |
| 6,821,014 | B2 * | 11/2004 | Hiranuma et al. | 368/295 |
| 7,434,984 | B2 * | 10/2008 | Hiranuma et al. | 368/295 |
| 2003/0099165 | A1 * | 5/2003 | Terasawa | 368/294 |

OTHER PUBLICATIONS

Patent Abstracts of Japan, publication No. 2005-326280, publication date Nov. 24, 2005.
Patent Abstracts of Japan, publication No. 2008-128880, publication date Jun. 5, 2008.

* cited by examiner

*Primary Examiner* — Renee S Luebke
*Assistant Examiner* — Jason Collins
(74) *Attorney, Agent, or Firm* — Adams & Wilks

(57) ABSTRACT

A bezel member rotatably mounted to a case band member is provided with an accommodating groove, a pair of passing portions continuous with the accommodating groove at positions spaced apart by approximately 180°, and a pair of escape grooves continuous with both passing portions from the center side of the bezel member and open to the exterior of the case band member. The case band member is provided with engagement grooves arranged in a ring-like fashion so as to be opposed to the accommodating groove, and a ring-like reception groove surrounded by the engagement grooves and continuous with the engagement grooves. A lock member retains the bezel member at an arbitrary rotating position. The lock member has an arcuate spring portion accommodated in the accommodating groove, a pair of pushbutton portions passing through the passing portions and to be pushed in from the outside of the bezel member, and a stopper portion engaged with the engagement grooves and adapted to be detached from the engagement grooves when the pushbutton portions are pushed into the reception groove.

7 Claims, 11 Drawing Sheets

WATCH

BACKGROUND OF THE INVENTION

Field of the Invention

The present invention relates to a watch such as a wrist watch or a pocket watch equipped with a rotatable bezel.

The bezel is of a ring-like configuration, and is mounted to the outer periphery of the upper portion of a case band so that it can rotate in the peripheral direction of the case band. The bezel is rotated by the user, and is stopped at an arbitrary position. A scale of the bezel is indicated by the long hand of the watch, whereby it is possible to check, for example, the length of time that has elapsed since the rotation of the bezel is stopped. To secure reliability in such checking, there have been adopted contrivances to retain the bezel immovably at an arbitrary rotating position.

As such a contrivance, there is known a prior-art technique according to which an annulus-gear-like tooth portion is formed on the case band, and a lock member consisting of a plate spring having a lock portion is provided on the bezel; due to the urging force of this lock member, the lock portion is engaged with the tooth portion of the case band to prohibit the rotation of the bezel at an arbitrary rotating position, and there is mounted to the bezel a pressing member which helps to detach the lock portion from the tooth portion by moving the lock portion while pressing the same (See, for example, JP-A-2005-326280).

As another such contrivance, there is known a prior-art technique according to which an operating member having a sunken portion with an oblique push-up surface and adapted to be pushed back by a spring is provided so as to be capable of being pushed into the case band, and the case band member is provided with a click member upwardly urged by another spring and a stopper member adapted to move toward and away from the lower end of the click member as it gets in and out of the sunken portion, with the upper end portion of the click member being engaged/disengaged with/from a click groove provided in the back surface of the bezel as the operating member moves (See, for example, JP-A-2008-128880).

In the technique as disclosed in Patent Document 2, when the operating member is being pushed back by the spring, the stopper member is off the sunken portion and is held between the outer periphery of the operating member and the click member, and the click member is engaged with the click groove, so that rotation of the bezel is inhibited. And, when the operating member is pushed in, the stopper member enters the sunken portion and axial movement of the click member is possible, so that it is possible to rotate the bezel.

In each of the above prior-art techniques, there is provided a single pushbutton (which is a pressing member in Patent Document 1, and an operating member in Patent Document 2), and this pushbutton is pushed in by the user, whereby rotation of the bezel is permitted. In other words, the inhibition of the rotation of the bezel is effected at a single position.

Thus, if, while the wristwatch is being carried about, some object comes into contact with the single pushbutton so as to press it, there may be a fear of the bezel being inadvertently rotated thereupon.

As stated above, in the prior-art techniques, the reliability with which the bezel member set at a desired rotating position is prevented from being inadvertently rotated is rather low.

SUMMARY OF THE INVENTION

To solve the above problem, according to the present invention, one of a case band member and a bezel member rotatably mounted to this case band member, is provided with an accommodating groove extending in the peripheral direction thereof over a range of at least approximately 180°, a pair of passing portions continuous with the accommodating groove at positions spaced apart by approximately 180° and open to the outer periphery of the one member, and a pair of escape grooves continuous with the passing portions from the center side of the one member and open to mating surfaces of the two members; the other member is provided with a large number of engagement grooves arranged in a ring-like fashion in the peripheral direction of the other member so as to be opposed to the accommodating groove, and a ring-shaped reception groove surrounded by the engagement grooves and continuous with the engagement grooves; a lock member retaining the bezel member so as to prevent it from moving at an arbitrary rotating position with respect to the case band is mounted to the one member; and this lock member has an arcuate spring portion accommodated in the accommodating groove, a pair of pushbutton portions protruding from the spring portion so as to be away from each other and extending through the passing portions to undergo push-in operation from the outside of the one member, and a stopper portion provided on the spring portion and engaged with the engagement grooves and adapted to be detached from the engagement grooves when the pushbutton portions are pushed in to be received by the reception groove.

In the present invention, one of the case band member and the bezel member is the bezel member when the other member is the case band member, and is the case band member when the other member is the bezel member; conversely, when one member is the bezel member, the other member is the case band member, and when one member is the case band member, the other member is the bezel member. In the present invention, the technical means in which the accommodating groove extends over a range of approximately 180° and in which a pair of passing portions are open at positions spaced apart by approximately 180°, is a realization means for arranging the pair of pushbutton portions in a positional relationship allowing without a hitch a push-in operation to cause the pair of pushbutton portions to move toward each other; it is desirable for its angle to be within a range of 180°±15° and, more preferably, to be set at 180°. In the present invention, the mating surfaces of the two members mean the surfaces held in contact with each other in the thickness direction of the watch.

In the present invention, to rotate the bezel member, the user first grasps the bezel member or the case band member with the thumb and the index finger to perform a push-in operation on the pair of pushbutton portions of the lock member so as to move them toward each other against the spring portion of the lock member, whereby the pair of stopper portions of the lock member are moved to the escape groove and the reception groove to detach them from the engagement grooves provided in the bezel member or the case band member. As a result, the bezel member the retention (lock) of which with respect to the case band member has been canceled is rotated next, thereby making it possible to arrange the bezel member at an arbitrary rotating position. Finally, as the spring portion tends to be restored to the former position with the elastic force thereof by canceling the above-mentioned push-in operation, the pair of pushbutton portions protrude from the passing portions, and, at the same time, the pair of stopper portions are engaged with the engagement grooves. As a result, it is possible to lock the bezel member at the above-mentioned arbitrary rotating position.

As described above, to cancel the lock of the bezel member with respect to the case band member, it is necessary to perform push-in operation on both of the pair of pushbutton portions spaced apart by approximately 180°. Thus, while the watch of the present invention is being carried about, the probability of both of the pair of pushbutton portions being inadvertently pushed from the outside is low. At the same time, if one pushbutton portion is pushed in, the engagement of the stopper portion and the engagement grooves on the other pushbutton portion side is maintained, so that it is possible to suppress with high reliability an inadvertent rotation of the bezel member set at a desired rotating position.

A preferred mode of the present invention is characterized in that the one member is the bezel member, and that the other member is the case band member.

In this preferred mode, it is possible to perform push-in operation with one hand on the pair of stopper portions of the lock member mounted to the bezel member to cancel the lock of the bezel member with respect to the case band member and, at the same time, to grasp the bezel member, so that it is possible to continue to rotate the bezel member with one hand. Thus, when the watch is a wristwatch, it is possible to operate the bezel member with one hand while carrying about the watch (in a state in which the watch is attached to the arm), which is convenient from the viewpoint of handling.

In a preferred mode of the present invention, there is attached to said one member a click stopper having a click ball to be engaged/disengaged with/from the engagement grooves and a click spring pressing this ball against the engagement grooves.

In this preferred mode, the click ball of the click stopper is engaged with the engagement grooves, whereby it is possible to effect positioning on the stopper portions of the lock member and the engagement grooves. Thus, when the push-in operational force of the pushbutton portions is lost, the stopper portions received in the escape groove and the reception groove are smoothly engaged with the engagement grooves without being caught by the engagement grooves by the spring portion of the lock member, thus making it possible to retain the bezel member at a desired rotating position.

In a preferred mode of the present invention, the click stopper is arranged on the opposite side of the spring portion with respect to a straight line passing the pair of pushbutton portions.

In this preferred mode, there is no need to arrange the lock member and the click stopper in the radial direction of the watch, so that it is possible to prevent the watch from being radially enlarged.

In a preferred mode of the present invention, the lock member is formed as an integral unit.

In this preferred mode, the lock member is formed as a single component, so that there is no need for time and effort to assemble this member itself.

In a preferred mode of the present invention, the lock member is formed by a first component consisting of the spring portion and the stopper portions formed integrally therewith, and a second component constituting the pushbutton portions, formed separately from the first component, and connected to the spring portion.

In this preferred mode, the spring portion and the pair of pushbutton portions are separate from each other, so that they can be designed according to their function. Thus, even if, for example, the spring portion is linear, it is possible to determine the configuration and material of the pushbutton portions without being restricted by this spring portion.

In a preferred mode of the present invention, with the bezel member being at a reference position, the pair of pushbutton portions are arranged off a straight line passing a crown mounted to the case band member and the center of case member.

In this preferred mode, the expression that the bezel member is at a reference position means that a bezel member in a state in which the number "0" of marks consisting of numbers affixed to the bezel member is directed to 12 o'clock, is retained; in this state, the bezel member is in a standby state.

In this preferred mode, in the state in which the bezel member is at the reference position, the pushbutton portions and the crown do not overlap each other vertically, so that the crown does not constitute an obstruction when canceling the lock of the bezel member, and the pushbutton portions do not constitute an obstruction when performing crown operation.

In the watch of the present invention, it is possible to suppress with high reliability inadvertent rotation of the bezel member set at a desired rotating position.

BRIEF DESCRIPTION OF THE INVENTION

DETAILED DESCRIPTION OF THE PREFERRED EMBODIMENTS

In the following, the first embodiment of the present invention will be described in detail with reference to FIGS. 1 through 8.

Figure 1:
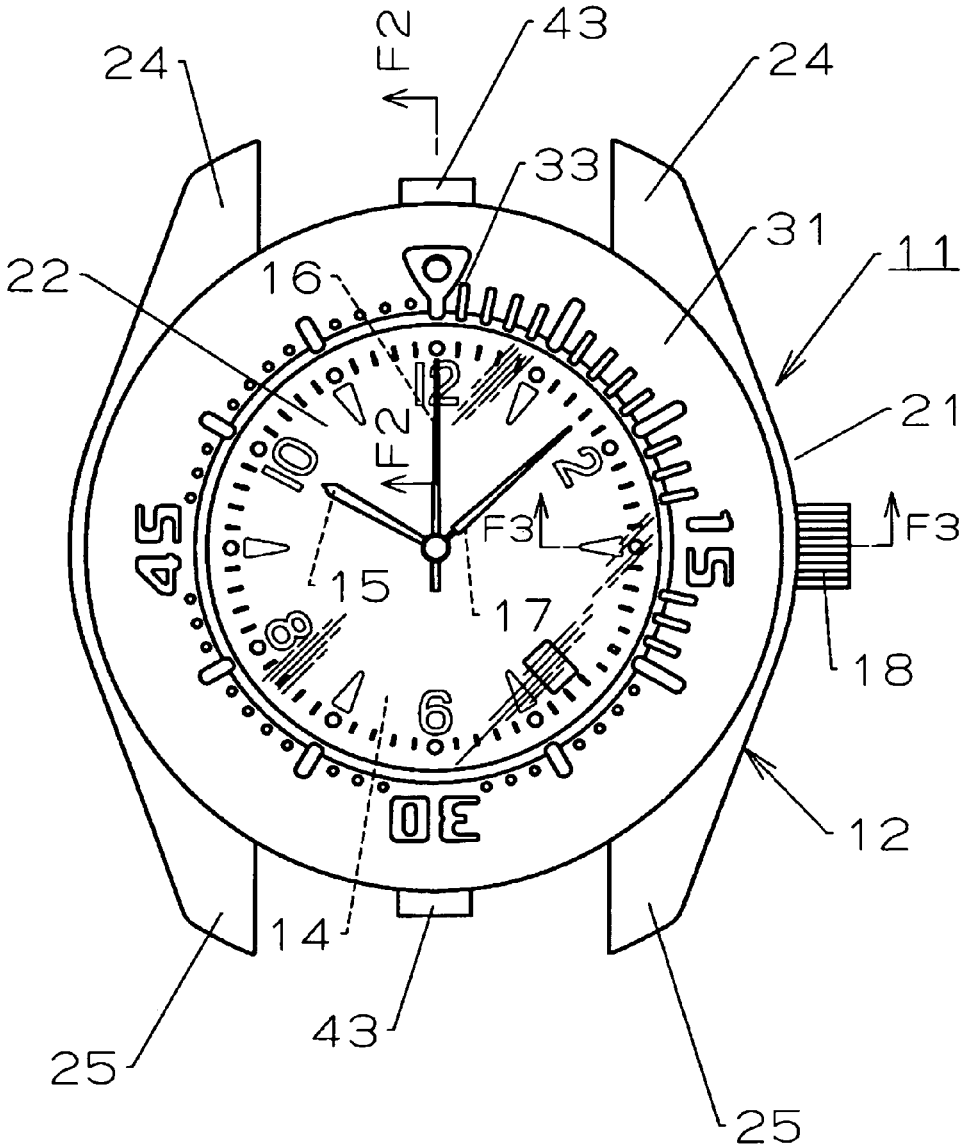
FIG. 1 shows a front view of a wristwatch according to a first embodiment of the present invention.
Figure 2:
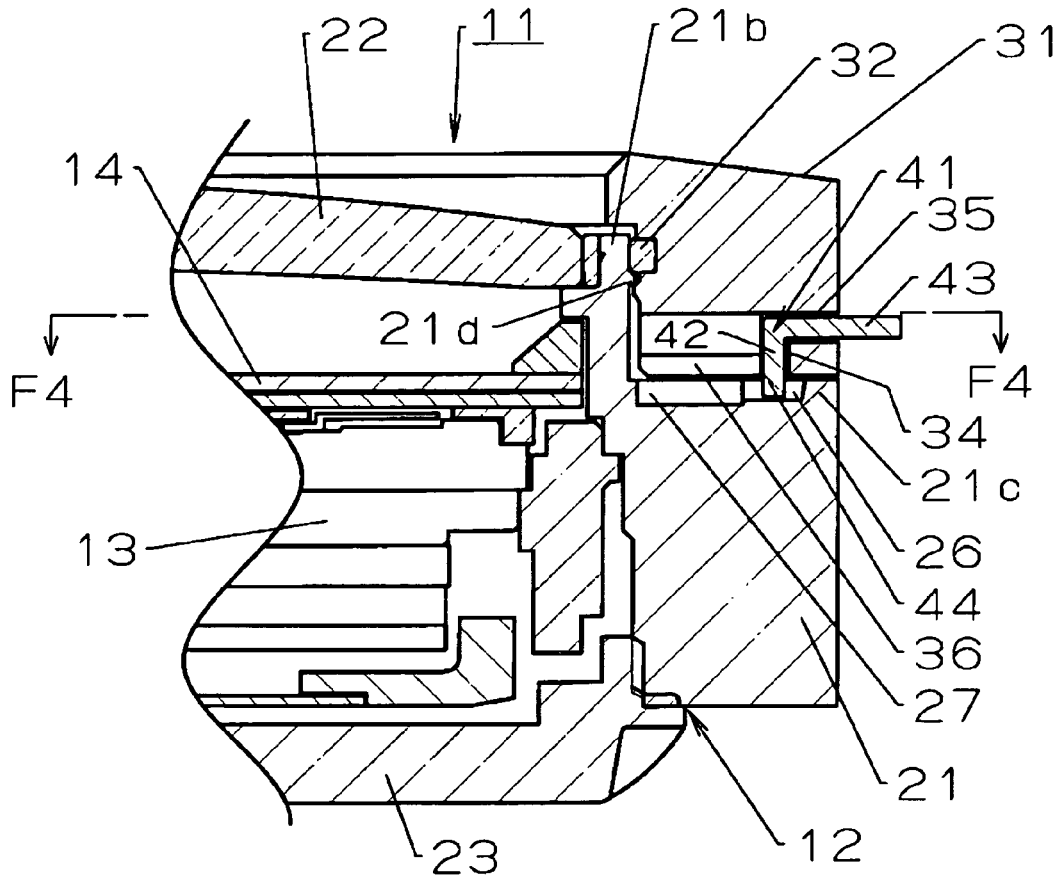
FIG. 2 shows a sectional view, taken along the line F2-F2 of FIG. 1, of the wristwatch of the first embodiment.
Figure 3:
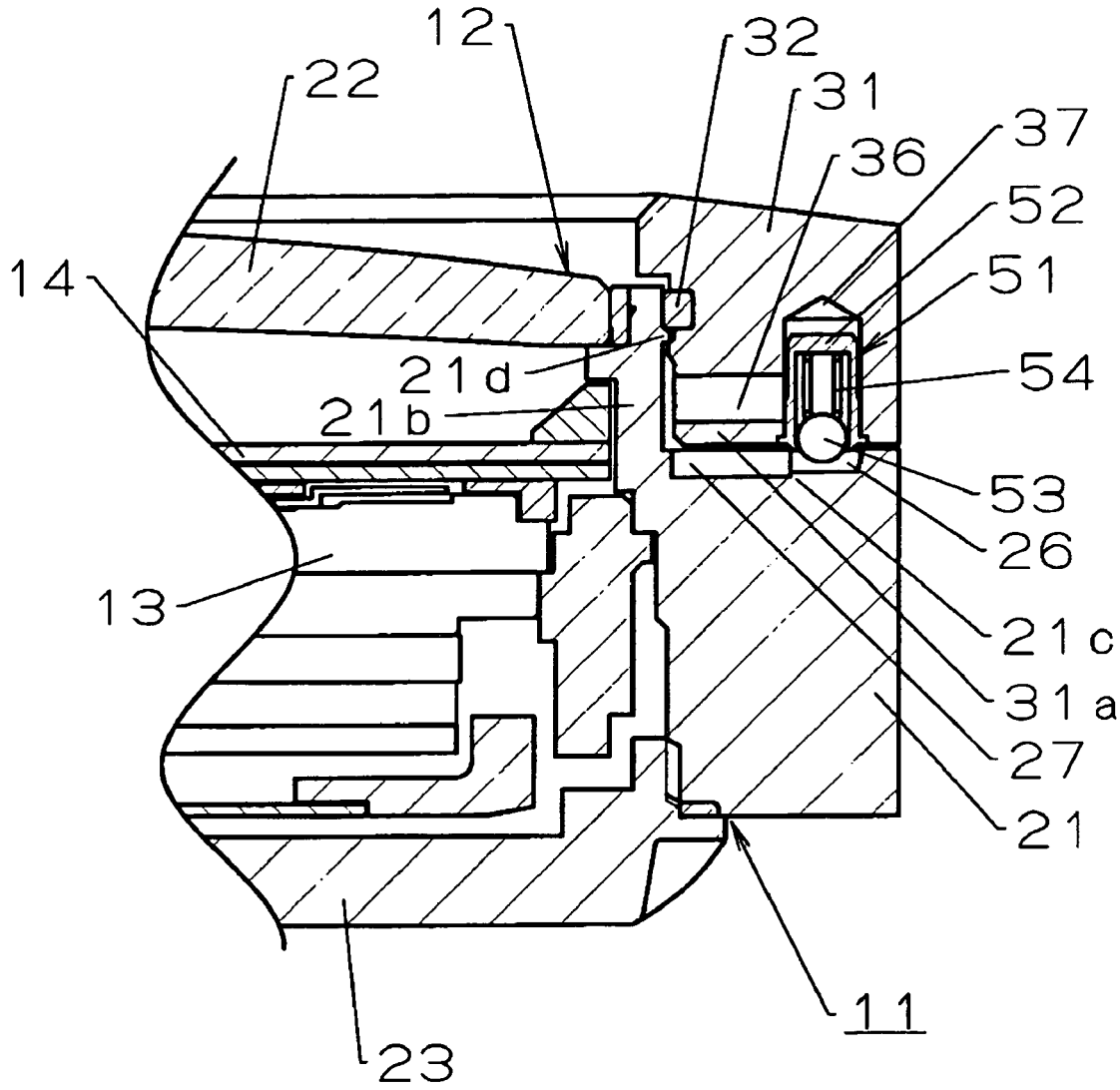
FIG. 3 shows a sectional view, taken along the line F3-F3 of FIG. 1, of the wristwatch of the first embodiment with the crown and the portion around the same omitted.

In FIGS. 1 through 3, numeral 11 indicates a portable watch such as a wristwatch. As shown in FIGS. 2 and 3, inside a watch exterior member 12 of the wristwatch 11, there is provided an inner component such as a watch movement 13, and, further, there is provided a time display portion such as a circular dial 14. The display on the dial 14 is effected by time indicating hands driven by the watch movement 13 and, more specifically, by a short hand 15, a long hand 16, and a minute hand 17 shown in FIG. 1. A crown 18 is mounted to the watch exterior member 12 in correspondence with the 3 o'clock time display side of the dial 14. The crown 18 is operated when, for example, adjusting the time indicating hands, etc. via the watch movement 13.

As shown in FIGS. 2 and 3, the watch exterior member 12 is equipped with a case band member 21, a glass 22, and a case back 23. The case band member 21 is formed in an annular configuration of a metal such as stainless steel or titanium or synthetic resin. The glass 22 enabling the dial 14 to be viewed from the outside is attached to the front portion of the case band member 21 in a liquid-tight fashion. The case back 23 is formed of metal or synthetic resin, and is attached liquid-tightly to close the rear surface of the case band member 21.

Figure 5:
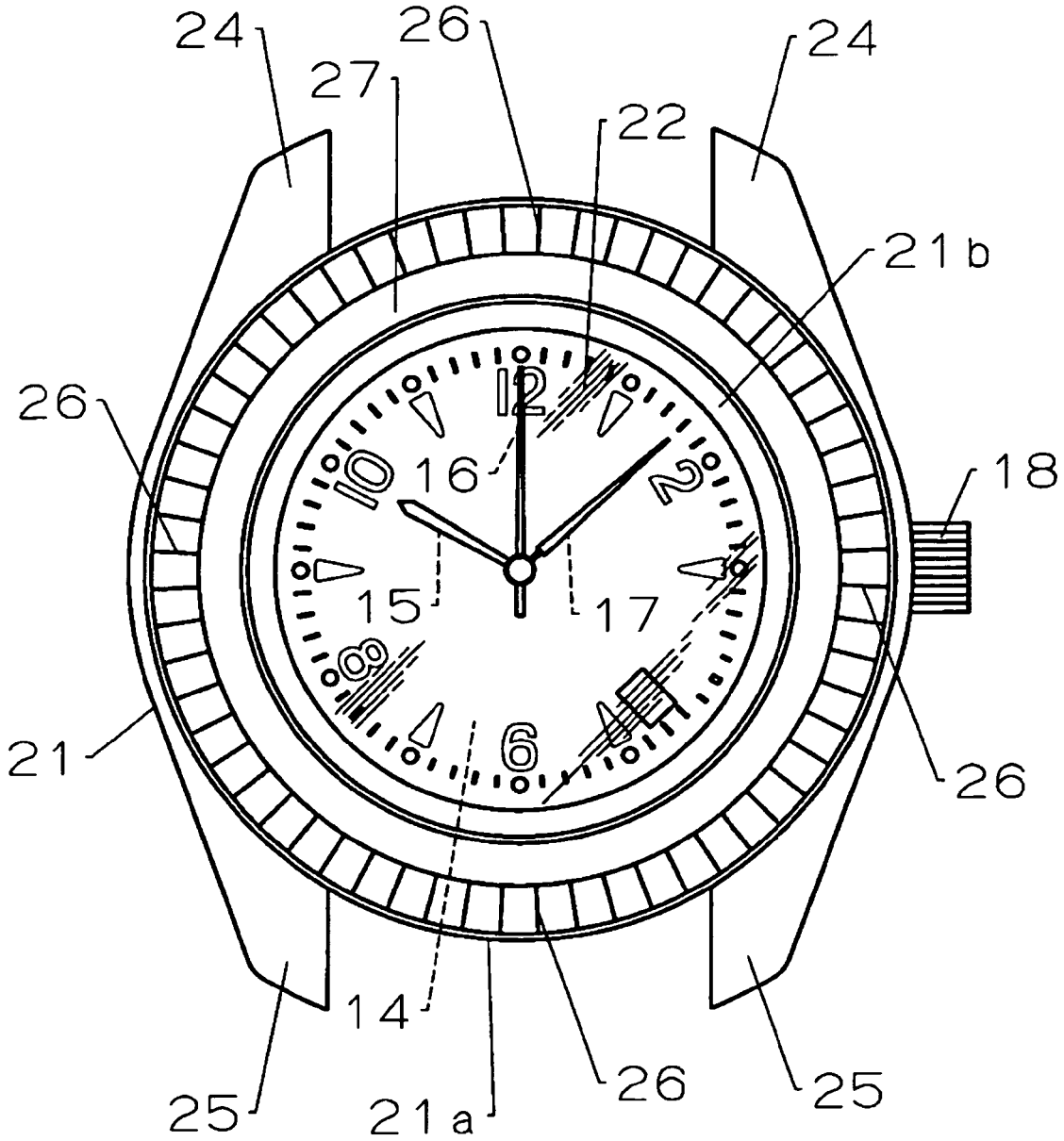
FIG. 5 shows a front view of the wristwatch of the first embodiment with a bezel member thereof removed.
Figure 6:
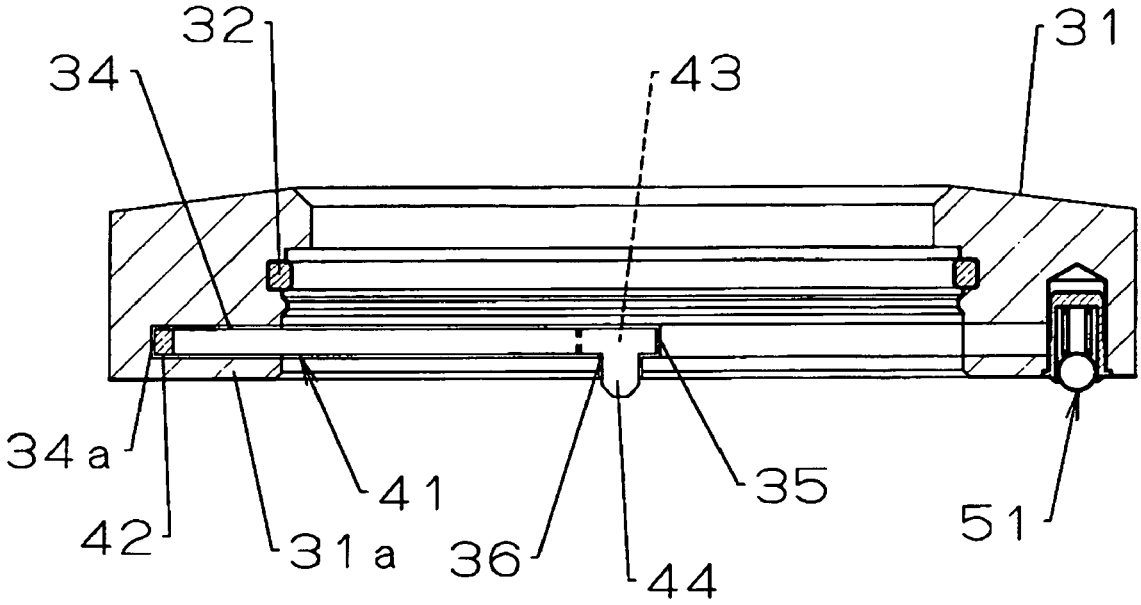
FIG. 6 is a sectional view showing the bezel member of the wristwatch of the first embodiment along with a component mounted thereto.

As shown in FIG. 5, as seen from the front side, the case band member 21 has an annular portion 21*a* surrounding the periphery of the dial 14, a pair of bow legs 24, and another pair of bow legs 25. In FIG. 5, the bow legs 24 protrude integrally from the upper portion of the annular portion 21*a*, and the other bow legs 25 protrude integrally from the lower portion of the annular portion 21*a* in FIG. 5; a wrist attachment member such as a belt (not shown) is mounted to these.

As shown in FIGS. 2 and 3, the case band member 21 has in the front portion thereof an upwardly directed protrusion 21*b*, and a shoulder portion 21*c* protruding outwardly from the proximal end of the upwardly directed protrusion 21*b*. The upwardly directed protrusion 21*b* is circular, and the glass 22 is attached to the inner peripheral portion thereof.

As shown in FIGS. 2, 3, and 5, the shoulder portion 21*c* is provided with a large number of engagement grooves 26 and a reception groove 27 that are open in the upper surface of the shoulder portion 21*c*.

The engagement grooves 26 are formed so as to be arranged in a ring-like form in the peripheral direction on the circular portion 21*a* of the case band member 21. The engagement grooves 26 are formed so as to radially extend with respect to the center of the case band member 21, and each of them exhibits a V-shaped sectional configuration as taken in a direction perpendicular to the direction in which it extends. Thus, the engagement grooves 26 adjacent to each other in the peripheral direction of the case band member 21 form therebetween protrusions of an isosceles-triangular sectional configuration. Due to this structure of the engagement grooves 26, when rotating a bezel member 31 described below to an arbitrary position, the direction thereof is not specified to one direction.

The reception groove 27 is formed in a ring-like configuration. The reception groove 27 is surrounded by the large number of engagement grooves 26 arranged in a ring-like form. The reception groove 27 is continuous with respective engagement grooves 26 from the center side of the case band member 21, more specifically, from the upwardly directed protrusion 21*b* side.

Both the reception groove 27 and the large number of engagement grooves 26 are open in the upper surface of the shoulder portion 21*c* of the case band member 21, that is, in the surface (mating surface) to be brought into contact with the back surface of the bezel member 31 described below. Thus, in forming these grooves by machining, it is possible to adopt press working instead of cutting, so that it is possible to attain a satisfactory workability with respect to the member having the large number of engagement grooves 26 and the reception groove 27, that is, the case band member 21 in this embodiment, which is desirable from the viewpoint of achieving an improvement in terms of productivity.

As shown in FIGS. 2 and 3, the bezel member 31 is rotatably mounted to the outer periphery of the upper portion of the case band member 21 so as to cover the upwardly directed protrusion 21*b* and the shoulder portion 21*c*. The bezel member 31 is formed in a ring-like configuration of metal or synthetic resin, and has an outer diameter substantially equal to the outer diameter of the shoulder portion 21*c*. The bezel member 31 is prevented from being detached by being caught from below by an engagement protrusion 21*d* formed in the outer periphery of the upwardly directed protrusion 21*b* so as to extend in the peripheral direction thereof. A friction ring 32 arranged immediately above this engagement portion is mounted to the inner periphery of the bezel member 31.

As shown in FIG. 1, marks 33 in the form of a scale or the like are provided on the surface of the bezel member 31. The marks 33 consist, for example, of a scale corresponding to 60 minutes, and include the numbers "0," "15," "30," and "45" provided for each 90°. When it is not being used, the bezel member 31 is normally arranged at a reference position as shown in FIG. 1. In the state in which the bezel member 31 is arranged at this reference position, the number "0" of the mark 33 indicating 0 minutes coincides with 12 o clock of the dial 14.

The bezel member 31 is provided with an accommodating groove 34, a pair of passing portions 35, and a pair of escape grooves 36.

Figure 4:
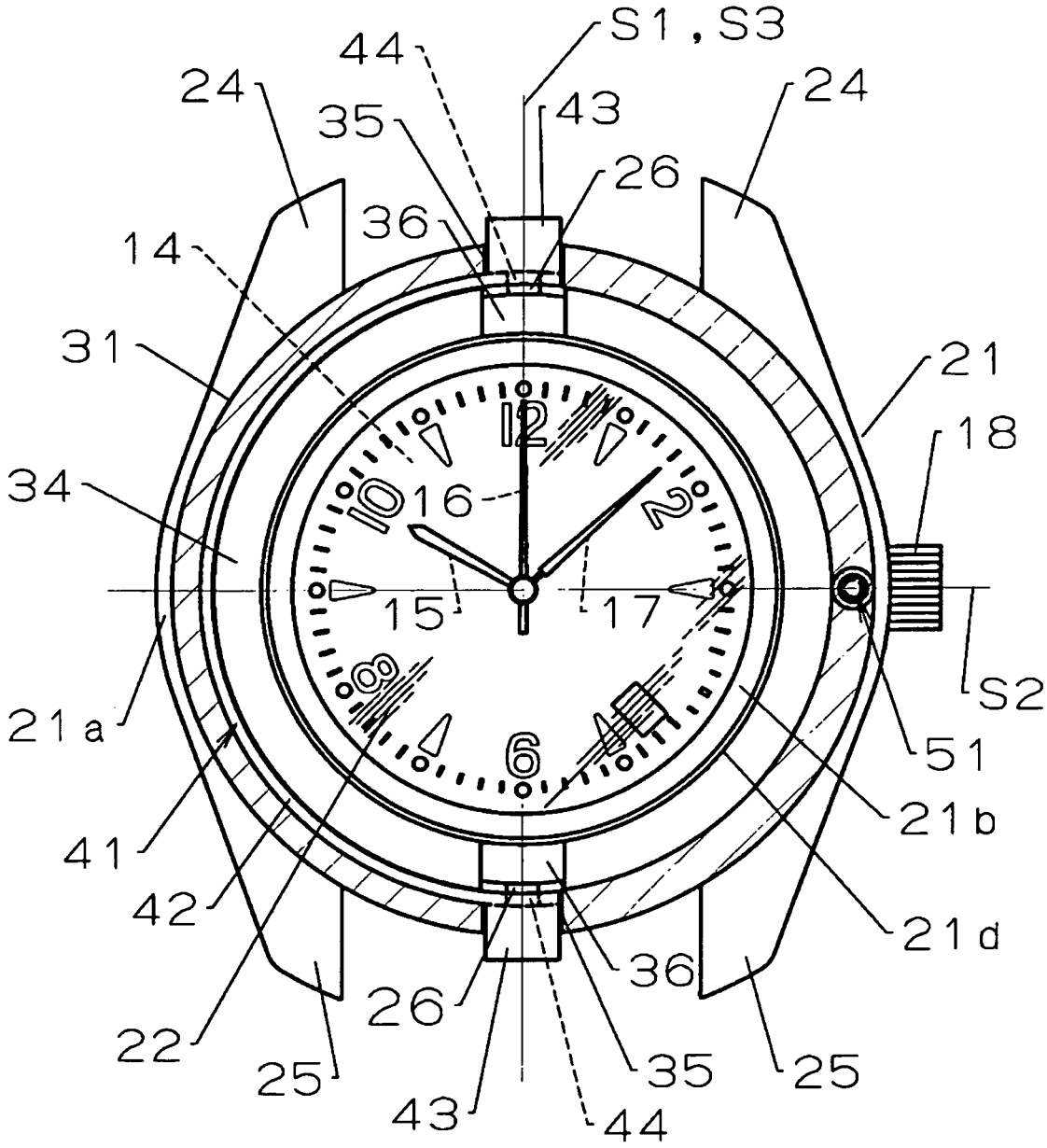
FIG. 4 shows a general sectional view, taken along the line F4-F4 of FIG. 2, of the whole wristwatch of the first embodiment.
Figure 7:
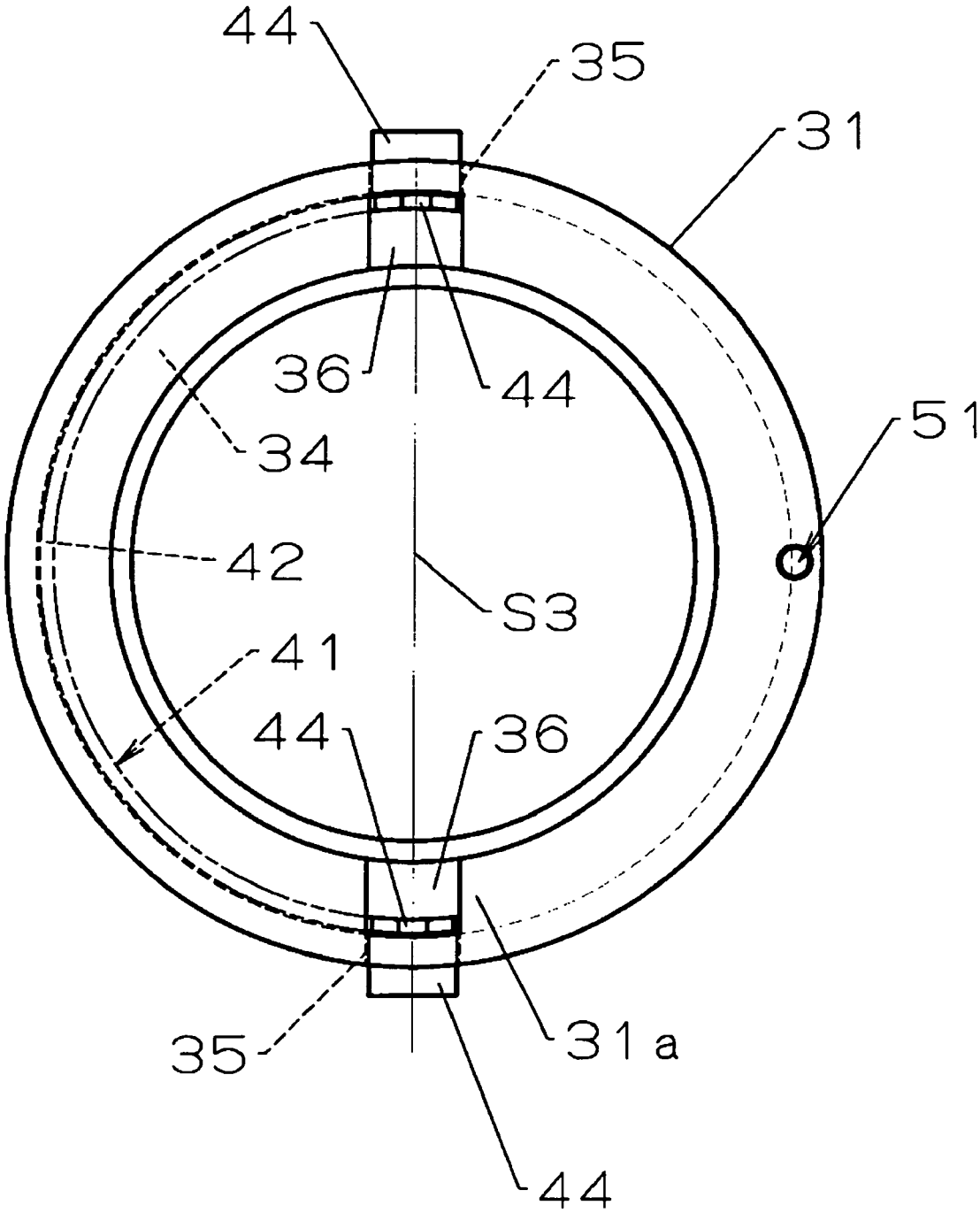
FIG. 7 is a rear view showing the bezel member of the wristwatch of the first embodiment along with a component mounted thereto.

The accommodating groove 34 is provided in the back side portion of the bezel member 31 over a range of at least approximately 180° of the bezel member 31 and, more specifically, over a range of 360° as shown in FIGS. 4 and 7. The accommodating groove 34 is open in the inner peripheral surface of the bezel member 31 (See FIGS. 2, 3, and 6).

The pair of passing portions 35 are provided apart from each other by approximately 180°, more preferably, by 180° so as to be opposed to each other in the diametrical direction of the bezel member 31 (See FIGS. 4 and 7). The passing portions 35 are continuous with the accommodating groove 34, and are open in the outer periphery of the bezel member 31.

Like the passing portions 35, the pair of escape grooves 36 are provided apart from each other by approximately 180°, more preferably, by 180° so as to be opposed to each other in the diametrical direction of the bezel member 31. As shown in FIG. 4, the escape grooves 36 are continuous with the center side of the case band member 21, more specifically, the upwardly directed protrusion 21*b* side. At the same time, the escape grooves 36 are open in the lower surface of the bezel member 31, that is, the surface held in contact with the shoulder portion 21*c*. More specifically, as shown in FIGS. 2 and 7, the escape grooves 36 are made open in the back surface of the bezel member 31 by cutting out a part of a back wall portion 31*a* defining the accommodating groove 34 from below. As a result, the escape grooves 36 are also continuous with the accommodating groove 34. As shown in FIGS. 2 and 4, the passing portion 35 side end portions of the escape grooves 36 are opposed to the engagement grooves 26. In this case, the escape grooves 36 are opposed to the groove end portions situated on the center side of the case band member 21.

Figure 8:
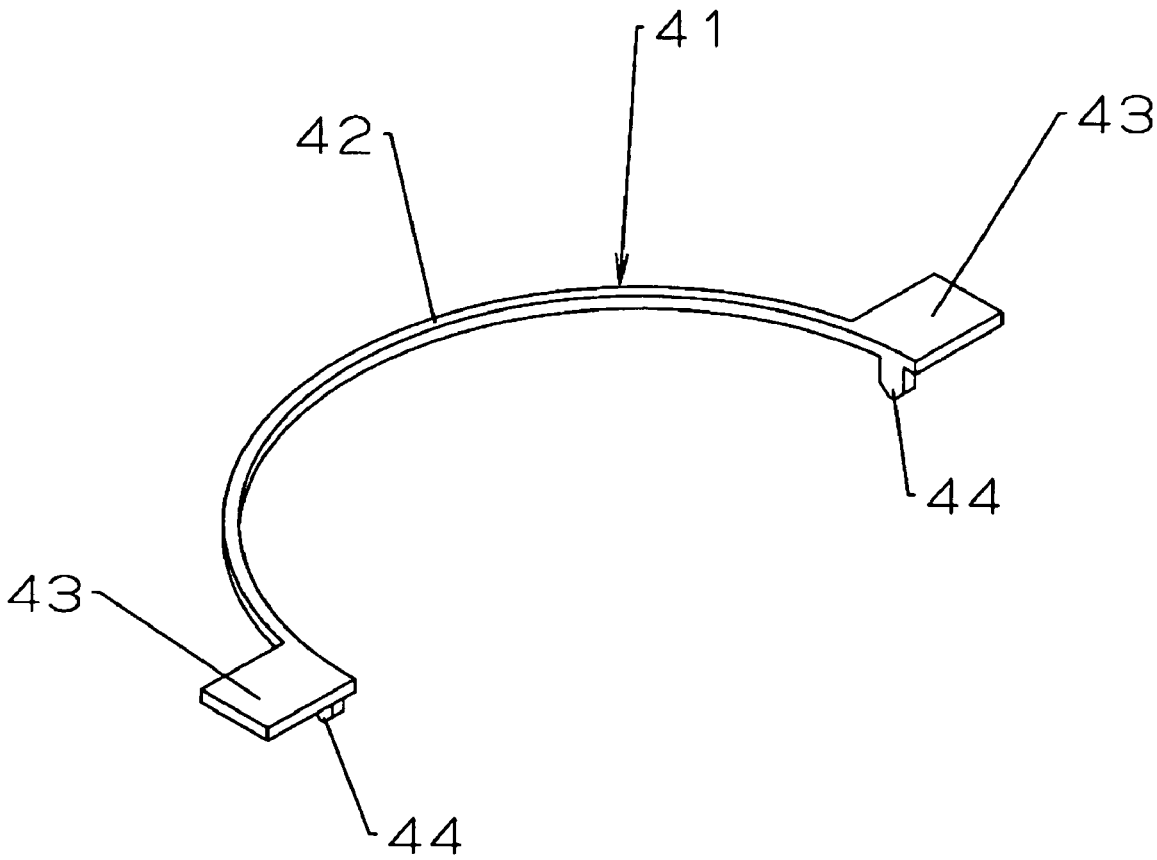
FIG. 8 shows a perspective view of a lock member with which the wristwatch of the first embodiment is equipped.

A lock member 41 is mounted to the member provided with the accommodating groove 34, the passing portions 35, and the escape grooves 36, which, in this embodiment, is the bezel member 31. As shown in FIG. 8, the lock member 41 has a spring portion 42, a pair of pushbutton portions 43, and a pair of stopper portions 44. The lock member 41 consists, for example, of an integral metal molding. Thus, the lock member 41 consists of a single component, which is advantageous in that there is no need for time and effort to assemble this component itself.

The spring portion 42 is of an arcuate configuration, for example, a semi-arcuate configuration extending over a range of approximately 180°, and is capable of elastic deformation.

The pair of pushbutton portions 43 are provided on the spring portions 42 so as to be spaced apart from each other by approximately 180°, in this embodiment, they are respectively provided at both end portions of the spring portion 42, and protrude from the spring portion 42 away from each other. The pair of stopper portions 44 are also provided on the spring portion 42 so as to be apart from each other by approximately 180°; in this embodiment, they are provided at both end portions of the spring portion 42 and protrude downwardly from the pushbutton portions 43. The forward end portions of the pushbutton portions 43 are tapered and engaged/disengaged with/from the engagement grooves 26.

As shown in FIGS. 4 and 7, the spring portion 42 of the lock member 41 is accommodated in the accommodating groove 34 so as to be in contact with and extend along a depth surface 34*a* (See FIG. 6) of the accommodating groove 34. The pushbutton portions 43 of the lock member 41 are respectively passed through the passing portions 35, and protrude so as to allow push-in operation from the outside of the bezel member 31. With the pushbutton portions 43 thus protruding to the exterior of the bezel member 31, the stopper portions 44 of the lock member 41 pass through the escape grooves 36 to protrude from the back surface of the bezel member 31, and are engaged with a part of the engagement grooves 26 of the case band member 21. Due to the elastic deformation of the spring portion 42, the lock member 41 thus mounted to the bezel member 31 is retained without involving any rattling, with the spring portion 42 being held in contact with the depth surface 34*a* of the accommodating groove 34.

The pair of pushbutton portions 43 are arranged off a straight line S2 passing the crown 18 and the center of the case band member 21, with the bezel member 31 being arranged at a reference position. More specifically, as shown in FIG. 4, etc., with the bezel member 31 being arranged at the reference position, the pair of passing portions 35, the pair of escape grooves 36, the pair of pushbutton portions 43, and the pair of stopper portions 44 are all arranged in a straight line S1 passing the 12 o'clock and 6 o'clock positions of the wristwatch 11.

In this arrangement of the pushbutton portions 43 with respect to the crown 18, the pushbutton portions 43 and the crown 18 do not vertically overlap each other, with the bezel member 31 being at the reference position, so that the crown 18 does not constitute an obstruction when canceling the lock of the bezel member 31, and, at the same time, the pushbutton portions 43 do not constitute an obstruction when operating the crown 18. Further, in the state in which the bezel member 31 is at the reference position, there is no fear of the pushbutton portions 43 being inadvertently pushed by the back of the user's hand, and, due to the pair of bow legs 24 and the pair of bow legs 25, it is advantageously possible to suppress inadvertent pushing-in of the pushbutton portions 43 by some object from the sides where the bow legs 24, 25 exist.

A click stopper 51 is mounted to the bezel member 31. As shown in FIGS. 4 and 7, the click stopper 51 is arranged on the opposite side of the spring portion 42 with respect to a straight line S3 passing the pair of pushbutton portions 43 (In FIG. 4, this straight line S3 coincides with the straight line S1 passing the 12 o'clock and 6 o'clock positions). As a result, there is no need to arrange the lock member 41 and the click stopper 51 provided apart from the lock member 41 in the radial direction of the wristwatch 11. Thus, it is advantageously possible to prevent the wristwatch 11 from being diametrically enlarged due to the arrangement of the click stopper 51.

As shown in FIG. 3, etc., the click stopper 51 include a ball holder 52, a click ball 53, and a click spring 54. It is of a cylindrical configuration, with the upper end of the ball holder 52 being closed, and the lower end thereof open. The click ball 53 consists of a steel ball or the like; it is accommodated in the ball holder 52 so as not to be detached from the opening at the lower end of the ball holder 52, and is vertically movable. The click spring 54 is provided between the closed upper end of the ball holder 52 and the click ball 53, urging the click ball 53 downwards.

The click stopper 51 is arranged with its ball holder 52 forced into amounting hole 37 provided in the bezel member 31. The click ball 53 of the click stopper 51 is detachably engaged with the engagement grooves 26 of the case band member 21, and, through the engagement/disengagement thereof, it is possible to provide a click feel each time the bezel member 31 rotates by a fixed angle with respect to the case band member 21.

At the same time, through the engagement of the click ball 53 with the engagement grooves 26, it is possible to effect positioning on the engagement grooves 26 with respect to the stopper portions 44 of the lock member 41. That is, simultaneously with the engagement of the click ball 53 with the engagement groove 26 directly below the same, it is possible to effect positioning on the bezel member 31 such that engagement is possible between the stopper portions 44 and the engagement grooves 26 at the corresponding positions. Thus, when the spring portion 42 of the lock member 41 is restored to the former state by its own elastic force as the push-in operational force with respect to the pushbutton portions 43 is lost, the stopper portions 44 received in the escape grooves 36 and the reception groove 27 are smoothly engaged without a hitch with the engagement grooves 26 at the corresponding positions, so that it is advantageously possible to retain the bezel member 31 at a desired rotating position.

In the state in which the wristwatch 11 constructed as described above is being carried about while attached to the arm of the user, the bezel member 31 is rotated in the following manner.

First, the user grasps the bezel member 31 with the thumb and the index finger of one hand to push the pair of pushbutton portions 43 of the lock member 41 into the passing portions 35 toward each other against the elastic force of the spring portion 42 of the lock member 41. In this case, the spring portion 42 undergoes deformation through deflection within the accommodating groove 34 of the bezel member 31 such that both end portions thereof move toward each other. With this, the pair of stopper portions 44 of the lock member 41 are detached from the engagement grooves 26 of the case band member 21 with which they have been engaged, and are moved toward the center side of the wristwatch 11 so as to be received by the escape grooves 36 and the reception groove 27.

Thus, the retention (lock) of the bezel member 31 with respect to the case band member 21 is canceled. In this case, the thumb and the index finger of the one hand with which the lock has been canceled are in a state in which they grasp the bezel member 31 so as to diametrically hold the bezel member 31 therebetween. Thus, subsequent to the pushing-in of the pair of pushbutton portions 43, it is possible to rotate the bezel member 31.

As described above, in arranging the bezel member 31 at an arbitrary rotating position, it is possible to perform the lock canceling operation of the bezel member 31 with respect to the case band member 21 and the rotating operation of the bezel member 31 with one behavior, so that it is possible to achieve an improvement in terms of operability.

As the bezel member 31 rotates, a click feel is provided each time the click ball 53 of the click stopper 51 is detached from the engagement groove 26 with which it has been engaged to enter the engagement groove 26 adjacent thereto in the rotating direction of the bezel member 31. In this case, the protrusion formed between the engagement grooves 26 adjacent to each other is of an isosceles-triangular sectional configuration, so that the bezel member 31 can be rotated in both clockwise and counterclockwise.

Thus, in arranging the bezel member 31 at an arbitrary rotating position, it is possible to rotate the bezel member 31 in the direction in which the position is nearer. At the same time, even when the bezel member 31 has moved past the arbitrary rotating position, it is possible to rotate the bezel member 31 reversely from that position to arrange it at the arbitrary rotating position, so that there is no need to cause the bezel member 31 to make still another rotation as in the case in which such reverse operation is impossible.

Next, in the state in which the bezel member 31 is arranged at the arbitrary rotating position, the bezel member 31 is released to cancel the pushing-in of the pair of pushbutton portions 43. As a result, the pair of pushbutton portions 43 protrude from the passing portions 35 due to the elastic force of the spring portion 42. At the same time, the pair of stopper portions 44 are engaged with the engagement grooves 26. Thus, it is possible to lock the bezel member 31 at the above-mentioned arbitrary rotating position.

As described above, in the wristwatch 11 constructed as described above, while it is being carried about, the pair of pushbutton portions 43 of the lock member 41 mounted to the bezel member 31 are pushed in with one hand to cancel the lock of the bezel member 31 with respect to the case band member 21 and, at the same time, the bezel member 31 can be grasped to continue to rotate the bezel member 31 with one hand, which is convenient from the viewpoint of handling ease.

And, in the wristwatch 11 constructed described above, to cancel the lock of the bezel member 31 with respect to the case band member 21, it is necessary to push in both of the pair of pushbutton portions 43 spaced apart from each other by approximately 180°. Thus, while the wristwatch 11 is being carried about, the possibility of both of the pair of pushbutton portions 43 being inadvertently pushed from the outside is low. At the same time, if one pushbutton portion 43 is pushed in, the engagement of the stopper portion 44 of the other pushbutton portion 43 and the engagement groove 26 is maintained, so that, while the wristwatch 11 is being carried about, it is possible to suppress with high reliability an inadvertent rotation of the bezel member 31 set at a desired rotating position.

Figure 9:
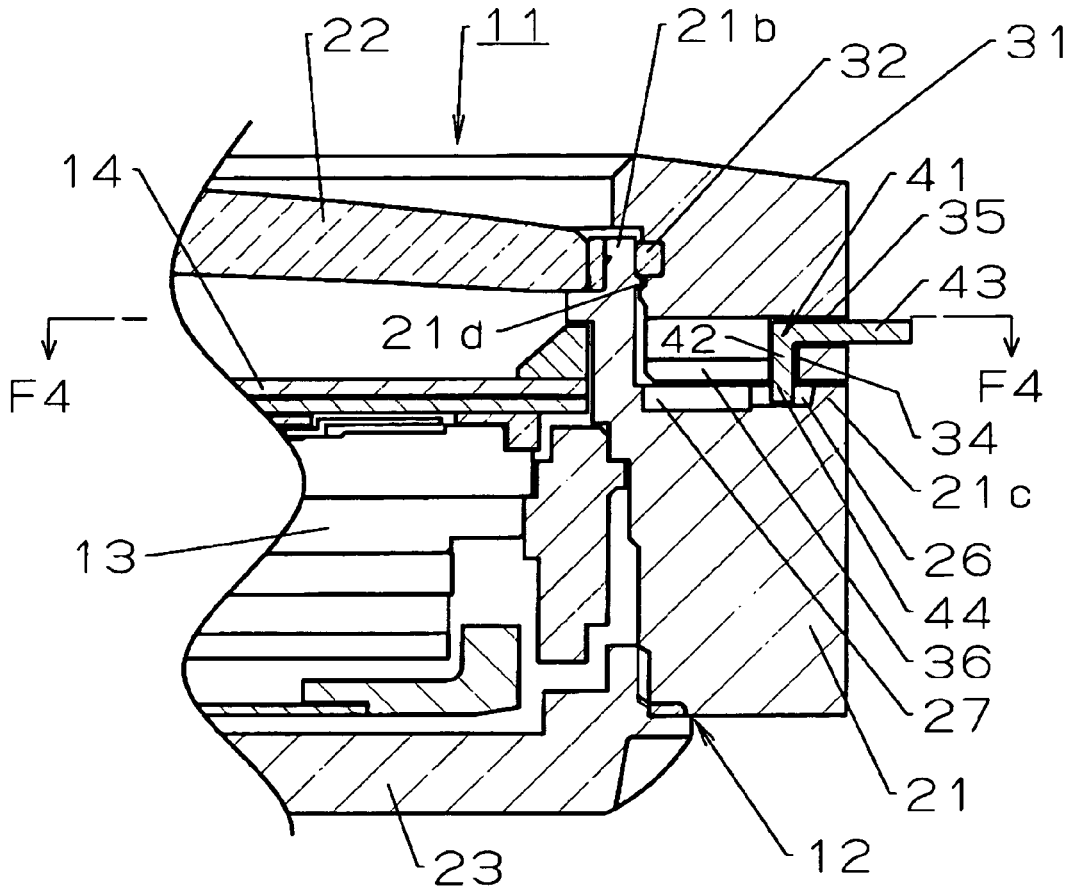
FIG. 9 shows a sectional view, corresponding to FIG. 2, of a wristwatch according to a second embodiment of the present invention.
Figure 10:
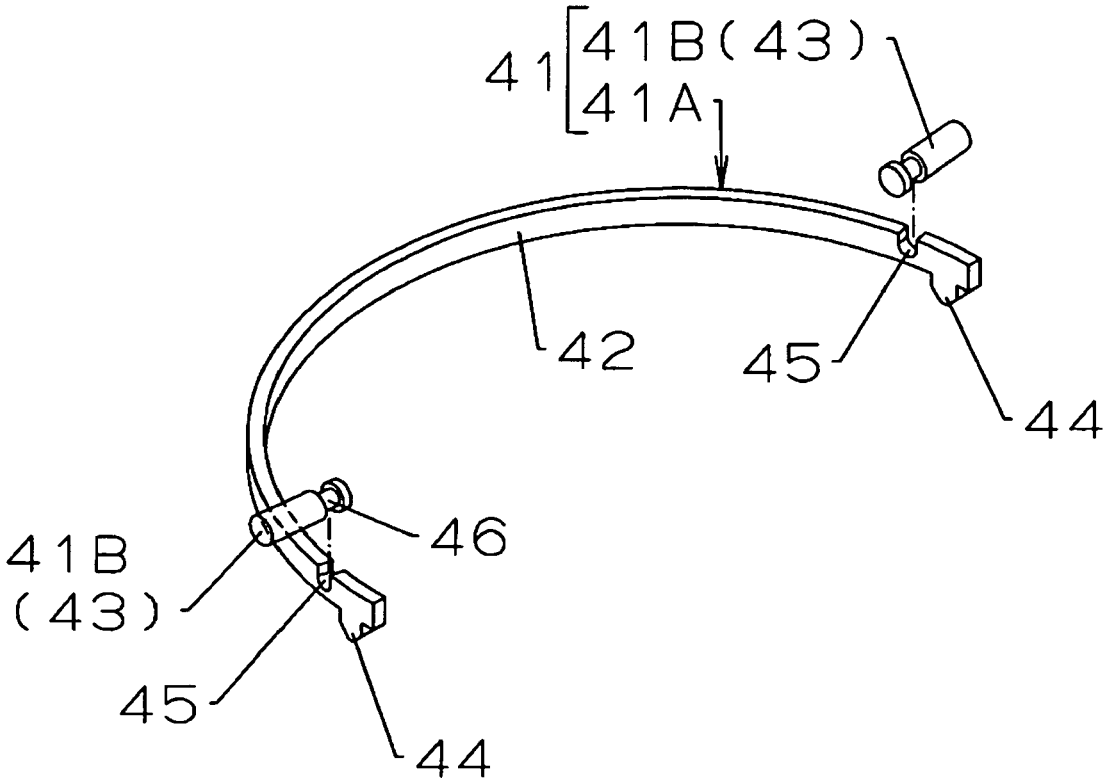
FIG. 10 shows an exploded perspective view of a lock member with which the wristwatch of the second embodiment is equipped.

FIGS. 9 and 10 show a second embodiment of the present invention. The wristwatch 11 of the second embodiment is the same as that of the first embodiment, inclusive of the technical matters not shown in FIGS. 9 and 10, except the technical feature that the lock member 41 is formed by a first component and a pair of second components. Thus, the components that are the same as those of the first embodiment are indicated by the same reference numerals, and a description thereof will be omitted.

As shown in FIG. 10, a first component 41A of the lock member 41 consists of the spring portion 42 and the stopper portions 44 integrally formed at both end portions thereof. Lock grooves 45 are respectively formed in both end portions of the spring portion 42. The lock grooves 45 are open in a direction reverse to the direction in which the stopper portions 44 protrude.

Second components 41B of the lock member 41 are formed separately from the first component 41A, and form the pushbutton portions 43. The second components 41B, that is, the pushbutton portions 43 are not of a plate-like but, for example, of a columnar configuration, each having at one end thereof an annular lock groove 46. As shown in FIG. 9, through locking of the lock grooves 45, 46, the first component 41A and the second components 41B are connected to each other to form the lock member 41.

As described above, the spring portion 42 and the pair of pushbutton portions 43 are separate from each other, so that they can be designed according to the function thereof. Thus, even if, for example, the spring portion 42 is linear, to improve the artistic design and the push-in operational feel of the wristwatch 11, it is possible to adopt round bars or bar members of a deformed configuration (i.e., a bar configuration other than that of round bars) as the pushbutton portions 43. Besides, the pushbutton portions 43 and the spring portion 42 can be made of different materials.

Except for the matters described above, the second embodiment is the same as the first embodiment. Thus, with the second embodiment also, it is possible to solve the problem of the present invention for the reason already described above with reference to the first embodiment.

Figure 11:
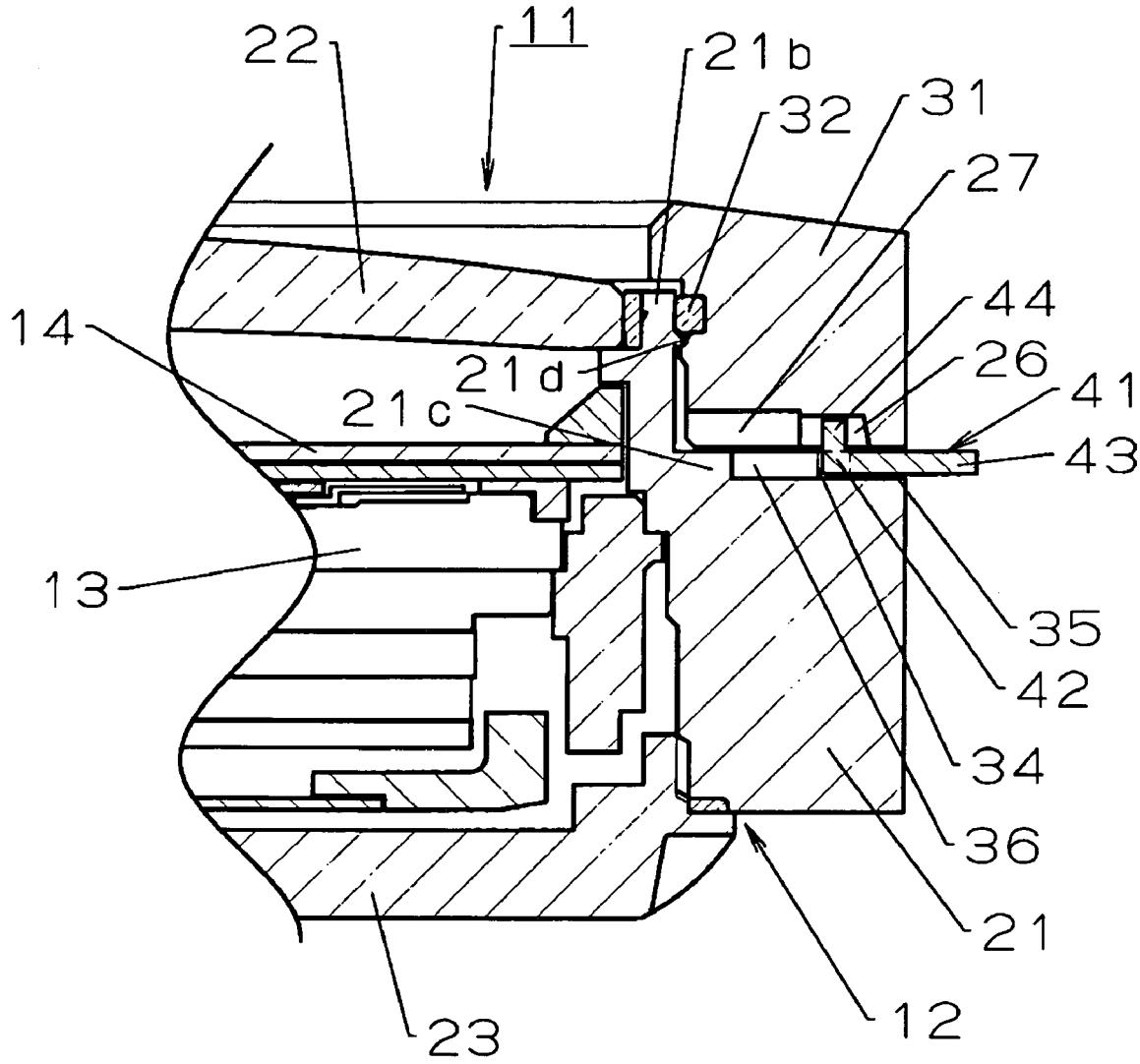
FIG. 11 shows a sectional view, corresponding to FIG. 2, of a wristwatch according to a third embodiment of the present invention.

FIG. 11 shows a third embodiment of the present invention. While in the first and second embodiments the lock member 41 is mounted to one of the case band member 21 and the bezel member 31, for example, the bezel member 31, reversely in the third embodiment, that one member is the case band member 21, and the lock member 41 is mounted to the case band member 21; except for this technical matter, this embodiment is the same as the first embodiment inclusive of the technical matters not shown in FIG. 11. Thus, the components that are the same as those of the first embodiment are indicated by the same reference numerals, and a description thereof will be omitted.

In the third embodiment, the accommodating groove 34, the pair of passing portions 35 (only one of which is shown), and the pair of escape grooves 36 (only one of which is shown), are provided in one of the case band member 21 and the bezel member 31, for example, in the shoulder portion 21*c* of the case band member 21. The accommodating groove 34, the pair of passing portions 35, and the pair of escape grooves 36 are all open in the upper surface of the shoulder portion 21*c*, which is the surface held in contact with the back surface of the bezel member 31. And, the lock member 41 is passed through the passing portions 35 and mounted to the shoulder portion 21*c* so as to be movable in the diametrical direction of the case band member 21.

Further, in the third embodiment, in the other of the case band member 21 and the bezel member 31, for example, in the bezel member 31, there are provided the large number of engagement grooves 26 arranged in a ring-like form and the ring-like reception groove 27 surrounded by them. The engagement grooves 26 and the reception groove 27 are open in the lower surface of the bezel member 31 covering the shoulder portion 21*c*.

Except for the matters described above, the third embodiment is the same as the first embodiment. Thus, in the third embodiment also, it is possible to solve the problem of the present invention for the same reason as already explained with reference to the first embodiment.

Further, when rotating the bezel member 31 in the third embodiment, the pair of pushbutton portions 43 are first pushed in with one hand, with the wristwatch 11 detached from the arm, and the state in which the lock of the bezel member 31 with respect to the case band member 21 is canceled is maintained with one hand. Next, the bezel member 31 is grasped by the other hand, and the bezel 31 is rotated to a desired rotating position before releasing the other hand from the wristwatch 11.

What is claimed is:

1. A watch comprising:

a case band member;

a bezel member rotatably mounted to the case band member;

one of the two members having an accommodating groove extending in the peripheral direction thereof over a range of at least approximately 180°, a pair of passing portions continuous with the accommodating groove at positions spaced apart by approximately 180° and open to the outer periphery of the one member, and a pair of escape grooves continuous with the passing portions from the center side of the one member and open to mating surfaces of the two members;

the other of the two members having engagement grooves arranged in a ring-like fashion in the peripheral direction thereof so as to be opposed to the accommodating groove, and a ring-shaped reception groove surrounded by the engagement grooves and continuous with the engagement grooves; and a lock member mounted to the one member and retaining the bezel member to prevent it from moving at an arbitrary rotating position with respect to the case band member, the lock member having an arcuate spring portion accommodated in the accommodating groove, a pair of pushbutton portions protruding from the spring portion so as to be away from each other and extending through the passing portions to undergo a push-in operation from the outside of the one member, and a stopper portion provided on the spring portion and releasably engaged with the engagement grooves and adapted to be detached from the engagement grooves when the pushbutton portions are pushed in to be received by the reception groove.

2. A watch according to claim 1; wherein the one member is the bezel member, and the other member is the case band member.

3. A watch according to claim 1; further comprising a click stopper mounted to the one member and having a click ball engageable with and disengageable from the engagement grooves, and a click spring for pressing the ball against the engagement grooves.

4. A watch according to claim 3; wherein the click stopper is arranged on the opposite side of the spring portion with respect to a straight line passing the pair of pushbutton portions.

5. A watch according to claim 1; wherein the lock member is formed as an integral unit.

6. A watch according to claim 1; wherein the lock member has a first component comprised of a spring portion and a stopper portion formed integrally therewith, and a second component constituting the pushbutton portions, formed separately from the first component, and connected to the spring portion.

7. A watch according to claim 1; wherein the bezel member defines a reference position, and the pair of pushbutton portions are arranged off a straight line passing a crown mounted to the case band member and the center of the case band member.

* * * * *